US007108006B2

(12) United States Patent
Armstrong

(10) Patent No.: US 7,108,006 B2
(45) Date of Patent: Sep. 19, 2006

(54) SUBSEA ACTUATOR ASSEMBLIES AND METHODS FOR EXTENDING THE WATER DEPTH CAPABILITIES OF SUBSEA ACTUATOR ASSEMBLIES

(75) Inventor: John Taylor Armstrong, Banchory (GB)

(73) Assignee: Vetco Gray Inc., Houston, TX (US)

( * ) Notice: Subject to any disclaimer, the term of this patent is extended or adjusted under 35 U.S.C. 154(b) by 706 days.

(21) Appl. No.: 10/189,046

(22) Filed: Jul. 2, 2002

(65) Prior Publication Data

US 2003/0037544 A1 Feb. 27, 2003

Related U.S. Application Data

(60) Provisional application No. 60/314,725, filed on Aug. 24, 2001.

(51) Int. Cl.
*F17D 1/18* (2006.01)
*F16K 17/36* (2006.01)

(52) U.S. Cl. ..... 137/14; 137/81.2; 91/417 R; 138/31; 251/63.5; 60/413

(58) Field of Classification Search ..... 137/81.2, 137/14; 91/417 R, 417 A; 138/31; 92/146; 251/63.5; 60/413
See application file for complete search history.

(56) References Cited

U.S. PATENT DOCUMENTS 2,945,352 A * 7/1960 Stelzer ..... 60/54.6
3,570,244 A * 3/1971 Strobel et al. ..... 60/51
3,677,001 A * 7/1972 Childers et al. ..... 60/398
4,024,884 A * 5/1977 Prescott et al. ..... 251/38
4,135,547 A * 1/1979 Akkerman et al. ..... 60/413
4,294,284 A * 10/1981 Herd ..... 137/613
4,311,297 A 1/1982 Barrington
4,382,364 A * 5/1983 Thomas et al. ..... 60/567
4,650,151 A 3/1987 McIntyre
4,777,800 A * 10/1988 Hay, II ..... 60/593
5,036,660 A * 8/1991 Aronne ..... 60/398
6,206,338 B1 3/2001 Trail et al.

* cited by examiner

*Primary Examiner*—A. Michael Chambers
(74) *Attorney, Agent, or Firm*—Bracewell & Giuliani LLP

(57) ABSTRACT

A hydraulic pressure compensation system for valve actuator assemblies is described having particular application for subsea wellhead installations. The compensation system includes at least one valve actuator assembly having a housing that retains a reciprocable piston therewithin. The piston is spring biased into its fail safe configuration. The valve actuator assembly is hydraulically associated with an accumulator reservoir that defines a closed fluid reservoir and an open fluid reservoir that is exposed to ambient pressures. The two chambers are separated by a membrane. The valve actuator assembly is also operationally associated with a fluid pressure intensifier that boosts the ambient pressure of the accumulator so that an increased fluid pressure may be transmitted to the actuator assembly to bias the actuated valve toward its fail safe configuration. In a described embodiment, the fluid pressure intensifier comprises a housing that defines a chamber having a fluid inlet and fluid outlet. A dual-headed piston is moveably retained within the housing. The piston has an enlarged piston face and a reduced size piston face. Fluid pressure entering the fluid inlet is exerted upon the enlarged piston face, and due to the difference of piston face sizes, an increased pressure is transmitted out of the fluid outlet.

10 Claims, 2 Drawing Sheets

SUBSEA ACTUATOR ASSEMBLIES AND METHODS FOR EXTENDING THE WATER DEPTH CAPABILITIES OF SUBSEA ACTUATOR ASSEMBLIES

CROSS-REFERENCE TO RELATED APPLICATIONS

This application claims the priority of provisional patent application Ser. No. 60/314,725 filed Aug. 24, 2001.

BACKGROUND OF THE INVENTION

1. Field of the Invention

The invention relates to actuator assemblies for the selective actuation of valves. In particular aspects, the invention relates to improved hydraulic pressure arrangements and fail safe systems for use in such assemblies.

2. Description of the Related Art

Gate valves and other sliding stem-type valves operate by selectively inserting a reciprocable stem into the flow of fluid to stop the flow when desired. Such valves assemblies are often used with subsea wellheads in order to control the flow of oil or gas from the wellhead. Conventional subsea actuator assemblies are used to selectively open and close valves in subsea Christmas trees, manifolds and other assemblies. Examples of such actuator assemblies are described in U.S. Pat. Nos. 4,311,297 and 4,650,151.

Subsea environments create special problems for the operation of such valves. In deep water production systems it is essential that the valves be made insensitive to ambient hydrostatic pressures. In other words, the operation of the valves should not be affected appreciably by the surrounding water pressure. Additionally, it is important that the valves incorporate a fail-safe feature that is intended to maintain the valve in a closed (or, if appropriate, open) position in the event of a loss of control pressure. In conventional designs, mechanical springs are used to bias the stem into the desired closed (or open) configuration. Such designs are often quite effective at shallow depths. However, difficulties arise when they are used at greater depths. Special problems are created by placement of wellheads in deep waters. The greater the water depth, the greater the spring force required to counteract the effects of hydrostatic head pressure on an unbalanced stem area. American Standard API 17D requires that this factor be taken into consideration when specifying the unit depth rating for a valve assembly. Other constraints, particularly those relating to the size and weight of subsea assemblies make it increasingly problematic to simply increase the mechanical spring force for greater depths.

Use of actuator assemblies that are totally sealed, i.e., the stem is sealed from hydraulic pressure, solves the problems of insensitivity and providing an adequate bias force upon the stem. However, the existence of such assemblies is not a complete solution. Completely sealed assemblies create problems when requirements for an independent rotary or linear override mechanisms are specified for the wellhead. In addition, completely sealed assemblies make provision for position indication difficult.

Improvements to the systems of the prior art would be desirable.

SUMMARY OF THE INVENTION

The invention provides an improved hydraulic pressure compensation system for valve actuator assemblies. The system of the present invention has particular application for subsea wellhead installations. The improved compensation system includes at least one valve actuator assembly having a housing that retains a reciprocable piston therewithin. The piston is spring biased into its fail safe configuration. The valve actuator assembly is hydraulically associated with an accumulator reservoir that defines a closed fluid reservoir and an open fluid reservoir that is exposed to ambient pressures. The two chambers are separated by a membrane. The valve actuator assembly is also operationally associated with a fluid pressure intensifier that boosts the ambient pressure of the accumulator so that an increased fluid pressure may be transmitted to the actuator assembly to bias the actuated valve toward its fail safe configuration. In a described embodiment, the fluid pressure intensifier comprises a housing that defines a chamber having a fluid inlet and fluid outlet. A dual-headed piston is moveably retained within the housing. The piston has an enlarged piston face and a reduced size piston face. Fluid pressure entering the fluid inlet is exerted upon the enlarged piston face, and due to the difference of piston face sizes, an increased pressure is transmitted out of the fluid outlet.

DETAILED DESCRIPTION OF THE PREFERRED EMBODIMENTS

Figure 1:
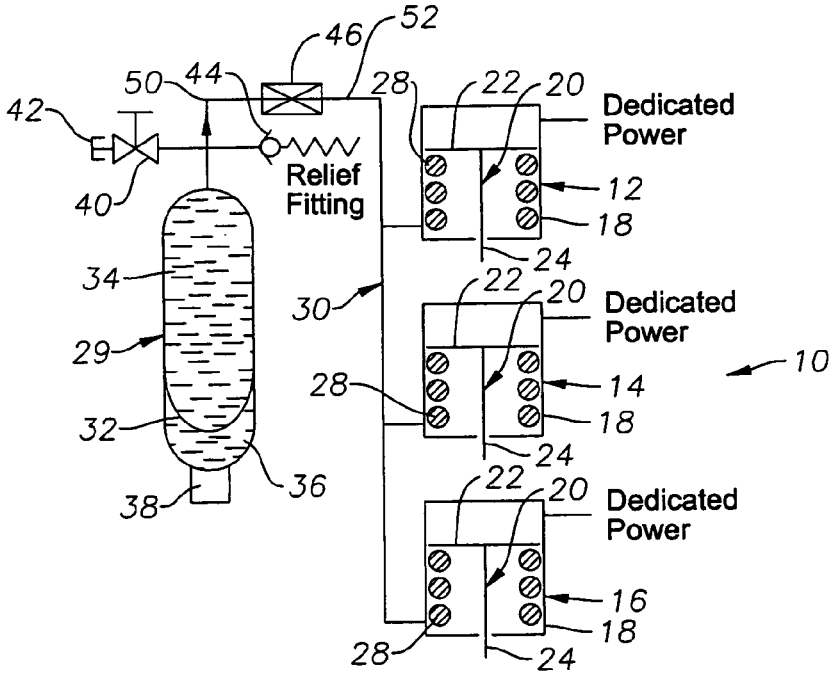
FIG. 1 is a schematic depiction of the hydraulic pressure system for an exemplary subsea actuator assembly constructed in accordance with the present invention.

FIG. 1 depicts, in schematic fashion, an exemplary hydraulic pressure compensation system 10 for a plurality of subsea actuator assemblies 12, 14 and 16. The assemblies 12, 14 and 16 each include an outer, generally cylindrical housing 18 with a piston 20 that is moveably disposed therein. A single exemplary actuator assembly 12 is shown in side cross-section in FIG. 3. The piston 20 features a piston head 22 with a stem 24 that, when moved axially, actuates a valve (not shown). A compressible spring 28 is used to bias each of the pistons 20 into a "fail-safe" closed (or open) position within its housing 18. Although not shown in FIG. 1, an opposite end of stem 24 is exposed to sea water. This exposure creates a force equal to the hydrostatic pressure of the sea water times the pressure area of the stem. The force on stem 24 is opposite to the force exerted by spring 28. As FIG. 1 shows, dedicated hydraulic power is provided to each of the actuator assemblies 12, 14 and 16 and, when used to energize the actuator assemblies so as to compress the spring 28, will open or close the valve associated with the energizer. The bias of the springs 28 upon the pistons 20 toward a closed position ensures that during a loss of hydraulic power from the dedicated power sources the valves will move to a fail safe position.

The system 10 includes a transfer barrier accumulator reservoir 29 that is interconnected in parallel via hydraulic piping, or conduits 30 to each of the actuator assemblies 12, 14, 16. The reservoir 29 encloses a flexible membrane 32 that defines a closed fluid chamber 34 within the reservoir 29. An open fluid chamber 36 is defined within the reservoir 29 and has a filtered opening 38 to the sea. The opening 38 allows the fluid chambers 34, 36 to be exposed to ambient pressure. The fluid in the closed fluid chamber 34 is generally either hydrocarbon-based or a water glycol with corrosion inhibitors, depending upon the fluid used in the power side of the actuators 12, 14, and 16. The membrane 32 transfers the hydrostatic head pressure present in the open fluid chamber 36 to the pressure compensation system 10. The filling of the compensation system 10 with fluid is such that, as the actuators 12, 14, 16 are powered forward, there is sufficient volume for fluid displaced from the piston chambers to enter the transfer barrier accumulator.

The hydraulic piping arrangement 30 includes a fill point isolation valve 40 with a blanking plug 42. These components are used to fill the compensation system 10 with an appropriate fluid during assembly of the system and prior to its deployment on the sea floor. A relief fitting 44 is also incorporated into the piping arrangement 30. The relief fitting 44 is a relief valve that is biased into a closed position by a spring. Excessive fluid pressure, of the type that might damage the piping arrangement 30 is bled out through the relief fitting 44.

Figure 2:
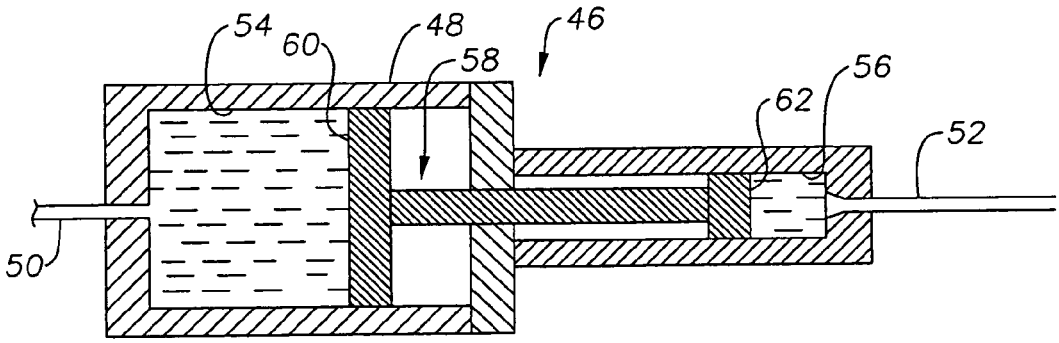
FIG. 2 illustrates an exemplary in-line pressure intensifier device.

A fluid pressure intensifier 46 is disposed within the piping assembly 30 between the reservoir 29 and the actuator assemblies 12, 14, 16. The structure of an exemplary pressure intensifier 46 is illustrated in FIG. 2. As seen there, the intensifier 46 includes an outer, fluid tight housing 48 having a fluid inlet 50 at one end and a fluid outlet 52 at the opposite end. The fluid inlet 50 extends from the accumulator 29 to the intensifier 46. The fluid outlet 52 leads toward the actuator assemblies 12, 14, 16. The housing 48 has an enlarged diameter chamber section 54 and a reduced diameter chamber section 56, each being filled with hydraulic fluid. A dual-headed piston 58 is moveably retained within the housing 48 so that an enlarged piston face 60 is presented within the enlarged chamber section 54 and a reduced-size piston face 62 is presented within the reduced diameter chamber section 56. The ratio of sizes of area as between the enlarged piston face 60 and the reduced size piston face 62 may be tailored to the applicable water depth requirements for the system 10 taking due cognizance of any structural limitations (should the system be employed on existing hardware.)

The intensifier 46 receives fluid pressure from the fluid inlet 50 and transmits an increased fluid pressure into fluid outlet 52 via the difference in piston head area between the enlarged piston face 60 and the smaller face 62. As a result, the ambient pressure of the accumulator 29 is boosted via the intensifier 46 so that a higher amount of pressure acting on the actuator piston area creates an additional load to augment the available spring load. The force of the spring and the boosted pressure cause the assemblies to move to their fail safe closed positions when the hydraulic pressure holding the piston in the opposite direction is removed. Thus, the assemblies 12, 14, 16 and system 10 are usable at greater depths than previous systems.

Figure 3:
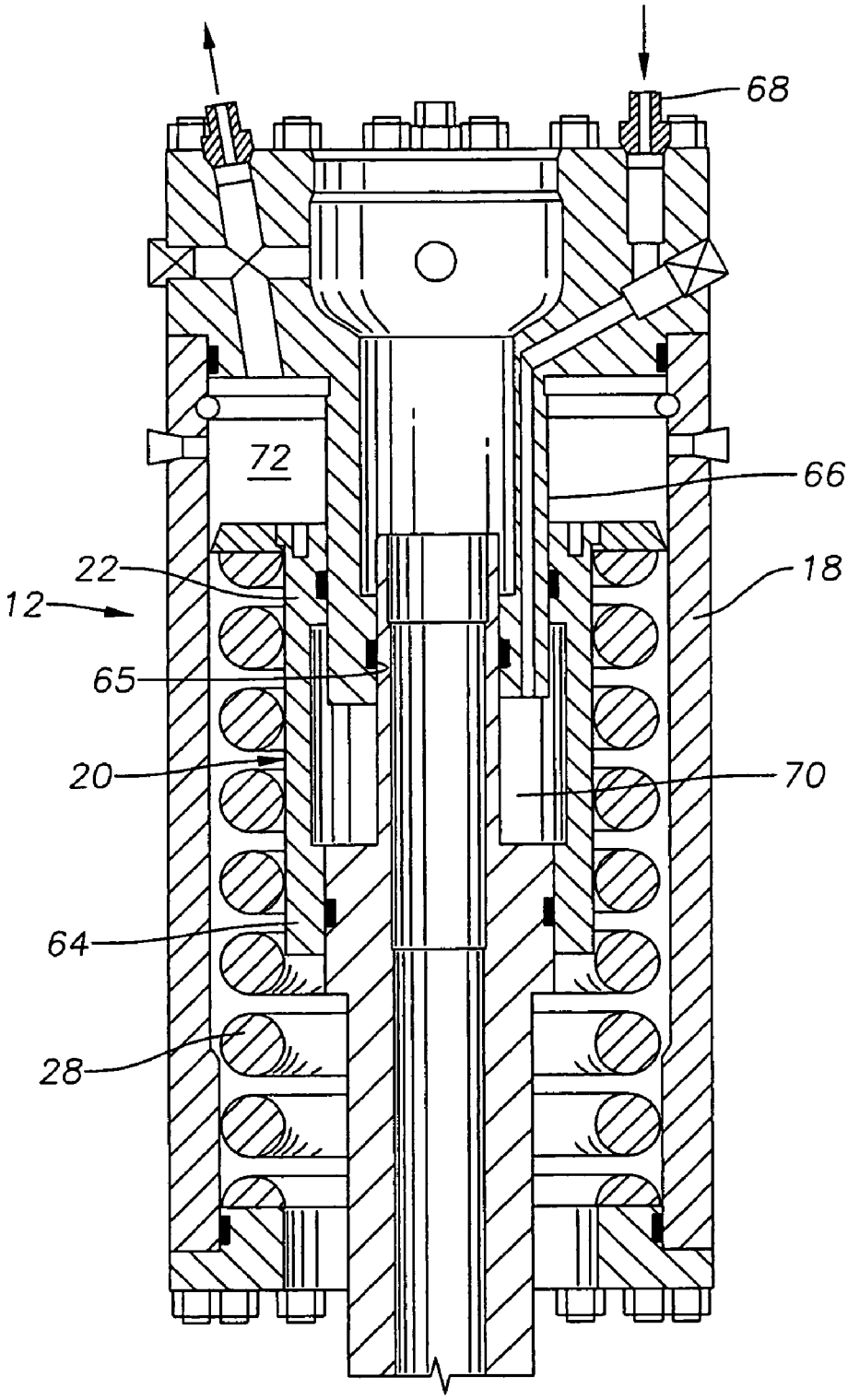
FIG. 3 is a side, cross-sectional view of a portion of an exemplary valve actuator used with the present invention.

Referring to FIG. 3, a sleeve 64 depends from and moves with piston 20, sleeve 64 having a passage to which a stem 24 (not shown in FIG. 3) is rigidly secured. Piston 20 has a seal 65 that slidingly engages a stationary tube 66. Fluid from a port 68 flows into a chamber 70 on a first side of piston head 22 to move piston 20 in a first direction, which is downward as shown in FIG. 3. Actuator 12 is bolted to a valve (not shown) and has a sealed chamber 72 enclosing spring 28 and piston 20. A port 74 applies and exhausts fluid from chamber 72. Conduit 52 (FIG. 1) is in fluid communication with chamber 72. The increased pressure over hydrostatic pressure in chamber 72 acts against the second side of piston head 22, tending to move it upward (as shown in FIG. 3) relative to fixed tube 66. Stem 24 (FIG. 1) is exposed to hydrostatic pressure through the open upper end of actuator 12, the hydrostatic pressure applying a downward force on piston 20. The increased pressure in chamber 72 counters this downward force, so that if the pressure in chamber 70 drops to ambient hydrostatic pressure, spring 28 is assisted by the higher pressure in chamber 72 to move the valve against the stem force to a fail safe portion.

The systems and methods of the present invention are advantageous since they allow for the retention of standard override and position indicator mechanisms. Additionally, they provide for reliable failsafe closure for actuated valves.

Those of skill in the art will recognize that many modifications and alterations of the described embodiment may be made. It is, therefore, intended that all equivalent modifications and variations fall within the spirit and scope of the present invention as claimed.

What is claimed is:

1. A method of operating a subsea valve, comprising:

connecting to the valve an actuator having a piston with first and second sides and a spring acting against the second side;

exposing one side of a fluid accumulator to sea water hydrostatic pressure and communicating an opposite side of the fluid accumulator to a lower pressure side of a pressure intensifier;

communicating a higher pressure side of the pressure intensifier with a second side of the piston, thereby applying a hydraulic fluid pressure to the second side of the piston that is greater than the sea water hydrostatic pressure;

moving the valve to a first position by applying hydraulic fluid pressure to the first side of the piston at a level sufficient to overcome forces created by the fluid pressure on the second side of the piston and the spring; and in the event the hydraulic fluid pressure on the first side of the piston to drops to the sea water hydrostatic pressure, moving the valve to a fail safe position with the forces created by the fluid pressure on the second side of the piston and the spring.

2. The method according to claim 1, wherein the actuator has a stem, and the method further comprises exposing the stem to the sea water hydrostatic pressure, which applies a force that urges the piston toward the first position.

3. A hydraulic pressure compensation system for use in selective actuation of a subsea valve, the system comprising:

at least one valve actuator assembly for selective actuation of a valve, the actuator assembly having an actuator piston with a first side for receiving hydraulic fluid pressure to move the valve to a selected position, the actuator assembly having a spring on a second side of the piston;

a fluid accumulator reservoir hydraulically associated with the valve actuator assembly, the fluid accumulator reservoir having a pressure equalizing barrier for increasing pressure in the fluid accumulator reservoir to sea water hydrostatic pressure;

a hydraulic fluid conduit operably interconnecting the valve actuator assembly and the fluid accumulator reservoir for transmission of pressurized fluid between the reservoir and the actuator assembly; and a fluid pressure intensifier operably disposed in the conduit between the fluid accumulator reservoir and the second side of the actuator piston of the valve actuator assembly to increase fluid pressure transmitted from the reservoir to the actuator assembly to a level above hydrostatic sea water pressure, to assist the spring in returning the piston to a fail safe position in the event the pressure on the first side of the piston drops to hydrostatic sea water pressure.

4. The hydraulic pressure compensation system of claim 3 wherein the fluid pressure intensifier comprises:

a housing defining an interior chamber with a fluid inlet and a fluid outlet;

a dual-headed piston within the interior chamber.

5. The hydraulic pressure compensation system of claim 4 wherein the dual-headed piston provides a first face having a first area and in communication with the fluid accumulator reservoir and a second face having a second area and in communication with the second side of the actuator piston, the second area being smaller than the first area.

6. The hydraulic pressure compensation system of claim 1 wherein the barrier of the fluid accumulator reservoir comprises a a flexible membrane.

7. The hydraulic pressure compensation system of claim 1 wherein the actuator assembly further comprises a stem that is movable with the piston, the stem having an end portion that is adapted to be exposed to sea water hydrostatic pressure.

8. A hydraulic pressure compensation system for use in selective actuation of a subsea valve, the system comprising:

at least one subsea valve actuator assembly for selective actuation of a valve, the actuator assembly having an actuator piston and a stem for moving a subsea valve in a first direction when supplied with hydraulic fluid pressure to a first side of the actuator piston, the actuator assembly having a spring on a second side of the actuator piston for urging the piston in a second direction, a portion of the stem adapted to be exposed to hydrostatic sea water pressure that creates a stem force that urges the actuator piston in the first direction;

a subsea fluid accumulator reservoir having a movable barrier with a sea water side for exposure to hydrostatic sea water pressure and a hydraulic fluid side in contact with hydraulic fluid in the fluid accumulator reservoir for applying hydrostatic sea water pressure to the hydraulic fluid in the fluid accumulator reservoir;

a hydraulic fluid conduit operably interconnecting the valve actuator assembly and the fluid accumulator reservoir, the conduit extending from the hydraulic fluid side of the barrier to the second side of the actuator piston;

a fluid pressure intensifier operably connected to the conduit between the fluid accumulator reservoir and the valve actuator assembly to increase the pressure of the hydraulic fluid on the second side of the actuator piston above the sea water hydrostatic pressure to reduce the effect of the stem force on the first side of the actuator piston, thereby reducing a force required by the spring to move the piston in the second direction in the event of hydraulic fluid pressure failure, the fluid pressure intensifier comprising:

a housing defining an interior chamber with a fluid inlet and a fluid outlet; and a dual-headed piston within the interior chamber, the dual-headed piston having a first pressure-receiving face having a first area and a second pressure-receiving face having a second area, the second area being smaller than the first area.

9. The hydraulic pressure compensation system of claim 8 wherein the the second direction of movement of the valve actuator comprises a fail safe position.

10. The hydraulic pressure compensation system of claim 8 wherein the the movable barrier of the fluid accumulator comprises a flexible membrane.

* * * * *